US005541055A

United States Patent [19]

Ooi et al.

[11] Patent Number: 5,541,055

[45] Date of Patent: Jul. 30, 1996

[54] HEAT DEVELOPING PHOTOSENSITIVE MATERIAL AND IMAGE FORMED BY USING THE SAME

[75] Inventors: Takehiko Ooi; Tetsuro Fukui, both of Yokohama; Motokazu Kobayashi, Kawasaki; Kazunori Ueno, Inagi, all of Japan

[73] Assignee: Canon Kabushiki Kaisha, Tokyo, Japan

[21] Appl. No.: 310,347

[22] Filed: Sep. 22, 1994

[30] Foreign Application Priority Data

Sep. 28, 1993 [JP] Japan ..... 5-241466

[51] Int. Cl.[6] ..... G03C 1/498

[52] U.S. Cl. ..... 430/619; 430/581; 430/587; 430/600; 430/611; 430/613; 430/357

[58] Field of Search ..... 430/619, 613, 430/611, 600, 581, 203, 353, 587

[56] References Cited

U.S. PATENT DOCUMENTS

| | | | |
|---|---|---|---|
| 2,681,294 | 6/1954 | Beguin . | |
| 3,080,254 | 3/1963 | Grant . | |
| 3,672,904 | 6/1972 | de Mauriac . | |
| 4,123,274 | 10/1978 | Knight et al. . | |
| 4,220,709 | 9/1980 | de Mauriac . | |
| 4,268,626 | 5/1981 | Akiyama et al. | 430/619 |
| 4,359,523 | 11/1982 | Postle | 430/512 |
| 4,820,617 | 4/1989 | Higuchi et al. . | |
| 4,847,179 | 7/1989 | Boio et al. | 430/619 |
| 4,923,788 | 5/1990 | Shuttleworth et al. | 430/512 |
| 5,041,368 | 8/1991 | Pham | 430/600 |
| 5,171,657 | 12/1992 | Kagami et al. . | |
| 5,187,041 | 2/1993 | Mouri et al. . | |
| 5,258,282 | 11/1993 | Kagami et al. | 430/619 |

FOREIGN PATENT DOCUMENTS

| | | |
|---|---|---|
| 45-18416 | 6/1970 | Japan . |
| 47-11113 | 4/1972 | Japan . |
| 50-32927 | 3/1975 | Japan . |
| 55-42375 | 10/1980 | Japan . |
| 57-30828 | 2/1982 | Japan . |
| 57-138630 | 8/1982 | Japan . |
| 57-147627 | 9/1982 | Japan . |
| 58-15638 | 7/1983 | Japan . |
| 58-118639 | 7/1983 | Japan . |
| 59-55429 | 3/1984 | Japan . |
| 61-129642 | 6/1986 | Japan . |
| 64-24245 | 1/1989 | Japan . |

OTHER PUBLICATIONS

Organic Chemicals List, p. 31, published by Japan Research Institute for Photosensitizing Dyes, Co., Ltd. (1974).

Organic Chemicals List, p. 25, published by Japan Research Institute for Photosensitzing Dyes, Co., Ltd, (1988).

*Primary Examiner*—Thorl Chea

*Attorney, Agent, or Firm*—Fitzpatrick, Cella, Harper & Scinto

[57] ABSTRACT

A heat developing photosensitive material of the present invention has, on a substrate, a photosensitive layer containing at least an organic silver salt, a reducing agent, a photosensitive silver halide or a photosensitive silver halide forming agent, a cyanine dye and a cyclic carbonyl compound.

In an image forming method of the present invention, an image is exposed on the heat developing photosensitive material and then the exposed photosensitive material is heated.

6 Claims, No Drawings

HEAT DEVELOPING PHOTOSENSITIVE MATERIAL AND IMAGE FORMED BY USING THE SAME

BACKGROUND OF THE INVENTION

1. Field of the Invention

The present invention relates to a heat developing photosensitive material which permits the formation of an image by dry treatment, and an image forming method using the heat developing photosensitive material.

2. Description of the Related Art

Silver salt photography using a silver halide is a popular recording technique having excellent sensitivity and gradation. However, since treatment after image exposure is performed in a wet manner, this technique has problems with respect to poor workability, simplicity and safety.

On the other hand, research on dry materials which can eliminate dry treatment has been carried out and disclosed in Japanese Patent Publication Nos. 43-4921 and 43-4924. These materials comprise a photosensitive silver halide in a catalytic amount and a non-photosensitive organic silver salt as an image forming material. The organic silver salt is considered to function as an image forming material by the following mechanism:

(1) A latent image is formed on a catalytic amount of photosensitive silver halide by image exposure.

(2) When the photosensitive material is heated, the organic silver salt is reduced to silver by oxidation-reduction reaction of the organic silver salt and a reducing agent in the presence of the latent image as a catalyst to form an image.

A heat developing photosensitive material has the advantage that an image can be formed by dry treatment, not a wet process, and is thus used as a photosensitive material in various industrial fields of image communication, medical care, computer output, and the like. The heat developing photosensitive material contains a silver halide as a photosensitive component, and thus has high photosensitivity and can easily be sensitized within the visible region.

A semiconductor laser which is low-priced, small and lightweight and which has high-efficiency output, as compared with a gas laser, has recently been developed and brought into practical use. A low-priced compact system for high-performance dry image recording can thus be expected by using such a low-priced, small and lightweight laser light source and a heat developing photosensitive material.

In a conventional gelatinous silver halide photosensitive material for wet treatment, a cyanine dye is used for improving the photosensitivity to long-wavelength light, particularly red light. However, since the cyanine dye has an extremely low efficiency of sensitization for the dry treatment heat developing photosensitive material, it is considered to be unsuitable.

The wet treatment silver halide photosensitive material can also decolor a sensitizing dye during wet treatment. However, a conventional heat developing photosensitive material has the problem that decoloring cannot be sufficiently effected in the heating step, thereby causing difficulties in obtaining an image with a low minimum optical density. If the amount of the sensitizing dye added is decreased for reducing the minimum optical density, problems of poor sensitivity and poor resolution can occur.

The conventional heat developing photosensitive material also has the problem that its sensitivity significantly deteriorates if it is stored in an unused state for a long period of time.

SUMMARY OF THE INVENTION

An object of the present invention is to provide, for forming a compact and economical image system, a heat developing photosensitive material with excellent storability, and an image forming method using the same which is sensitive to red light or light emitted from a semiconductor laser, LED, etc. having an oscillation wavelength within the near infrared region, and which produces substantially no fogging.

A heat developing photosensitive material of the present invention comprises a photosensitive layer which is formed on a substrate, said photosensitive layer comprising an organic salt, a reducing agent, a photosensitive silver halide or photosensitive silver halide forming agent, a cyanine dye and a colorless cyclic carbonyl compound.

A method of forming an image the present invention comprises (a) exposing an image on the heat developing photosensitive material and (b) heating said exposed heat developing photosensitive material.

DETAILED DESCRIPTION OF THE INVENTION

A heat developing photosensitive material of the present invention comprises a photosensitive layer which is formed on a substrate and which contains at least an organic silver salt, a reducing agent, a photosensitive silver halide or photosensitive silver halide forming agent, a cyanine dye and a colorless cyclic carbonyl compound.

Preferred examples of the cyanine dye used in the present invention include compounds represented by the following formula (I):

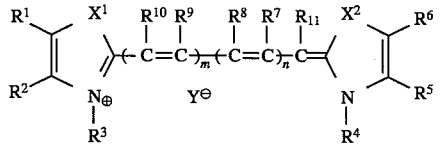

(I)

wherein $R^1$, $R^2$, $R^5$ and $R^6$ are each a hydrogen atom, an alkyl group, an alkoxy group, a halogen atom, a hydroxyl group, an aryl group, a carboxyl group, an alkoxycarbonyl group, a cyano group, a trifluoromethyl group, an amino group, an acylamido group, an acyl group, an acyloxyl group, an alkoxycarbonylamino group or a carboalkoxy group, and $R^1$ and $R^2$ or $R^5$ and $R^6$ may be combined with each other to form a benzene nucleus or a naphtho nucleus; $R^3$ and $R^4$ are each independently a substituted or unsubstituted alkyl group, an alkenyl group, a substituted or unsubstituted aryl group, a substituted or unsubstituted aralkyl group; $R^7$, $R^8$, $R^9$, $R^{10}$ and $R^{11}$ are each a hydrogen atom, a halogen atom, a substituted or unsubstituted alkyl group, an alkoxy group, a substituted or unsubstituted aryl group, or a substituted or unsubstituted amino group, and $R^7$ and $R^8$, $R^9$ and $R^{10}$, $R^7$ and $R^9$, $R^8$ and $R^{10}$ or $R^7$ and $R^{11}$ may be combined with each other to form a ring; $X^1$ and $X^2$ are each an oxygen atom, a sulfur atom or a selenium atom; and m and n are each 0 or an integer of 1 to 3, but are not 0 simultaneously.

Preferred examples of the cyanine dye used in the present invention are given below.

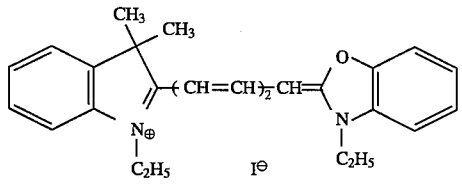

(I-1)

-continued (I-2)

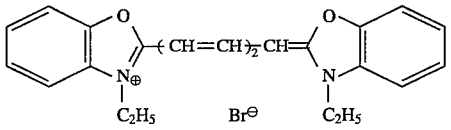

(I-3)

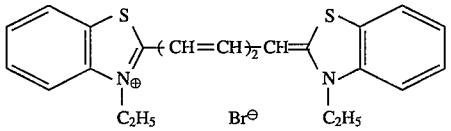

(I-4)

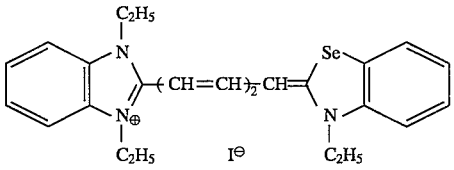

(I-5)

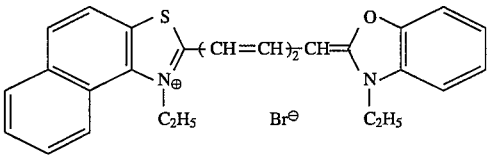

(I-6)

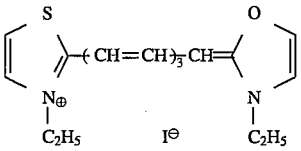

(I-7)

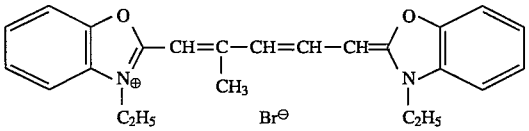

(I-8)

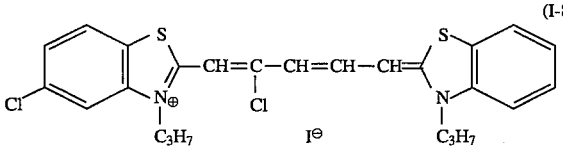

(I-9)

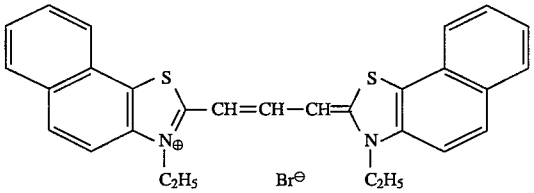

The photosensitive material of the present invention may simultaneously contain at least two different dyes of the above cyanine dyes.

The present invention uses a colorless cyclic carbonyl compound. In the present invention, the colorless cyclic carbonyl compound represents a cyclic carbonyl compound showing no absorption peak within the wavelength region of 400 nm to 1000 nm when light absorption characteristics are measured.

The cyclic carbonyl compound is dissolved in a suitable solvent (e.g., acetonitrile, methanol, chloroform, or ether) to form a solution at a concentration $5.0\times10^{-4}$ mol/l. The light absorption characteristics are measured by using the solution and a measuring device UV-3100S produced by Shimazu Seisakusho or U-3410 produced by Hitachi Seisakusho.

Preferred examples of the colorless cyclic carbonyl compound used in the present invention include compounds represented by the following formula (II):

(II)

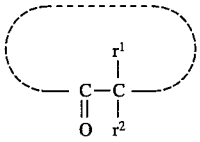

wherein $r^1$ and $r^2$ are each an hydrogen atom or an organic substituent.

Preferred examples of the organic substituent indicated by $r^1$ and $r^2$ include an alkyl group, an alkoxy group, a halogen atom, a hydroxyl group, an aryl group, a carboxyl group, an alkoxycarbonyl group, a cyano group, a trifluoromethyl group, an acylamido group, an acyl group, an alkoxycarbonylamino group and a carboalkoxy group.

The cyclic carbonyl compound represented by the formula (II) preferably has a five-membered ring or a six-membered ring, and, further includes, an amine represented by the following formula (III) in the ring of formula (II):

(III)

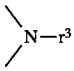

wherein $r^3$ indicates a hydrogen atom, an alkyl group, an aralkyl group or an aryl group.

It is particularly preferred that the amine represented by the above formula (III) is present at one or both sides of

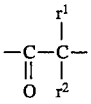

in the formula (II).

Rhodamine, hydantoin, barbituric acid or a derivative thereof is particularly preferred as the cyclic carbonyl compound of formula (II). Preferred examples of the cyclic carbonyl compound used in the present invention are given below.

(II-1)

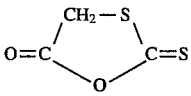

(II-2)

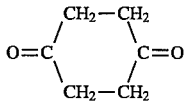

(II-3)

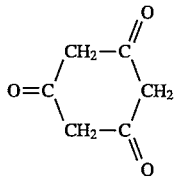

(II-4)

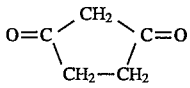

-continued
(II-5)
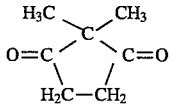
(II-6)
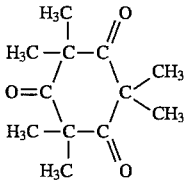
(II-7)
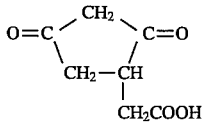
(II-8)
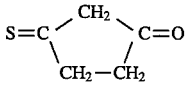
(II-9)
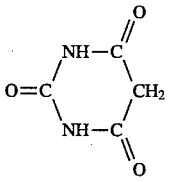
(II-10)
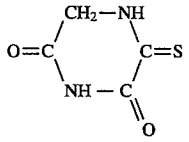
(II-11)
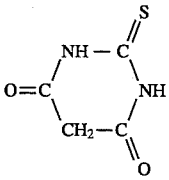
(II-12)
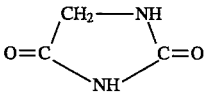
(II-13)
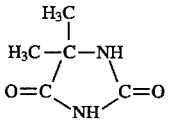
(II-14)
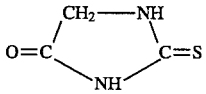
(II-15)
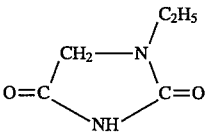
-continued
(II-16)
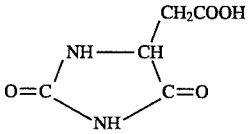
(II-17)
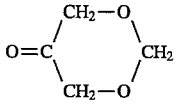
(II-18)
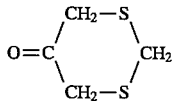
(II-19)
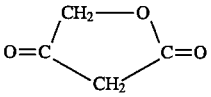
(II-20)
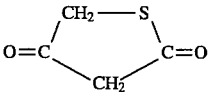
(II-21)
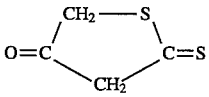
(II-22)
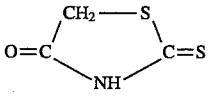
(II-23)
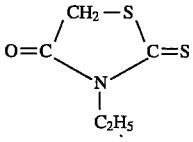
(II-24)
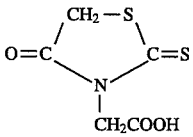
(II-25)
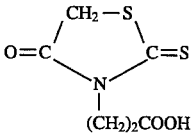
(II-26)
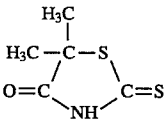
(II-27)
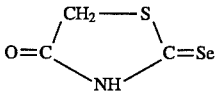
The photosensitive material of the present invention may simultaneously contain at least two different compounds of these cyclic carbonyl compounds.
The organic acid silver and triazole silver salts disclosed in "Basis of Photographic Engineering" (edited by the Japan Photographic Society, Corona Co., Tokyo, No. 1, issued in 1982), Non-Silver Salt, P 247, and Japanese Patent Laid-Open No. 59-55429 can be used as the organic silver salt. A silver salt having low photosensitivity is preferably used. Examples of such silver salts include silver salts of aliphatic carboxylic acids, aromatic carboxylic acids, thiol, thiocarbonyl compounds having a-hydrogen, and imino group-containing compounds.

Examples of aliphatic carboxylic acids include acetic acid, butyric acid, succinic acid, sebacic acid, adipic acid, oleic acid, linoleic acid, linolenic acid, tartaric acid, palmitic acid, stearic acid, behenic acid and camphoric acid. Since a silver salt generally becomes unstable as the number of carbons decreases, a compound having an appropriate number (for example, within the range of 16 to 26 carbon atoms) of carbon atoms is preferably used.

Examples of aromatic carboxylic acids include benzoic acid derivatives, quinolinic acid derivatives, naphthalene carboxylic acid derivatives, salicylic acid derivatives, gallic acid, tannic acid, phthalic acid, phenylacetic acid derivatives, pyromellitic acid and the like.

Examples of thiol or thiocarbonyl compounds having a-hydrogen include the mercapto compounds disclosed in U.S. Pat. No. 4,123,274, such as 3-mercapto-4-phenyl-1,2,4-triazole, 2-mercaptobenzoimidazole, 2-mercapto-5-aminothiadiazole, 2-mercaptobenzothiazole, S-alkylthioglycollic acid (an alkyl group having 12 to 23 carbon atoms), dithiocarboxylic acids such as dithioacetic acid, thioamides such as thiostearoamide, 5-carboxy-1-methyl-2-phenyl-4-thiopyridone, mercaptotriazine, 2-mercaptobenzoxazole, mercaptoxathiazole, 3-amino-5-benzylthio-1,2,4-triazole and the like.

Typical examples of imino group-containing compounds include benzotriazole or derivatives thereof which are disclosed in Japanese Patent Publication No. 44-30270 or 45-18416, such as benzotriazole, alkyl-substituted benzotriazoles such as methylbenzotriazole, halogen-substituted benzotriazoles such as 5-chlorobenzotriazole, and carboimidobenzotriazoles such as butylcarboimidobenzotriazole; nitrobenzotriazoles disclosed in Japanese Patent Laid-Open No. 58-118639; sulfobenzotriazole, carboxybenzotriazole or salts thereof and hydroxybenzotriazole, which are disclosed in Japanese Patent Laid-Open No. 58-115638; 1,2,4-triazole, 1H-tetrazole, carbazole, sacchaarin, imidazole and derivatives thereof, which are disclosed in U.S. Pat. No. 4,220,709.

Any agents which can reduce silver ion to metal silver can be used as the reducing agent.

Examples of such reducing agents include monophenols, bisphenols, trisphenols, tetrakisphenols, mononaphthols, bisnaphthols, dihyroxynaphthalenes, sulfonamidophenols, bisphenols, trihydroxynaphthalenes, dihydroxybenzenes, trihydroxybenzenes, tetrahydroxybenzenes, hydroxyalkyl monoethers, ascorbic acid, 3-pyrazolidones, pyrazolones, pyrazolines, sugars, phenylenediamines, hydroxyamines, reductones, hydroxamic acids, hydrazines, hydrazides, amidoximes, N-hydroxyurea and the like. Of these compounds, p-bisphenols, o-bisphenols, bisnaphthols, and 4-substituted naphthols are preferred. The reducing agents disclosed in U.S. Pat. No. 5,171,657 are also preferably used.

Examples of photosensitive silver halides include silver chloride, silver bromide, silver chlorobromide, silver iodobromide, silver chloroiodobromide and the like.

Such a silver halide can be prepared by the method of partially halogenating a silver oxide compound with a photosensitive silver halide forming component such as ammonium bromide, lithium bromide, sodium chloride or N-bromosuccinimide, or a method of containing so-called external silver halide.

Although crystal forms of such a silver halide include cubic, octahedron and plate, a cubic or plate-formed silver halide is particularly preferred. The length of one side of the cubic silver halide crystal is preferably 0.01 to 2 μm, more preferably 0.02 to 1.3 μm. The average aspect ratio of the plate-formed silver halide is preferably 100:1 to 3:1, more preferably 50:1 to 5:1. The particle size is preferably 0.01 to 2 μm, more preferably 0.02 to 1.3 μm.

The surface layer of the silver halide crystal may contain iridium ions. The crystal surface layer represents a layer which has a predetermined depth from the surface of silver halide crystal. In this case, the crystal system of silver halide is preferably the tetragonal system having a face index (1, 0, 0). The length of one side of the silver halide crystal is preferably 0.001 μm to 1.0 μm, more preferably 0.01 μm to 0.2 μm and most preferably 0.03 μm to 0.1 μm. The thickness of the crystal surface layer containing iridium ions is preferably not more than 10%, more preferably not more than 5%, of the length of one side of the crystal. The thickness of the crystal surface layer containing iridium ions is also preferably at least 0.5% of the length of one side of the crystal.

The silver halide containing iridium ion may be prepared by adding an iridium ion supply material when a silver halide is produced from the organic silver salt to be reduced and the silver halide forming component. Preferred examples of iridium ion supply materials include iridium tetrachloride, iridium (IV) potassium hexachloride, iridium (IV) sodium hexachloride and the like.

Iridium ions may be present in the crystal surface layer of the silver halide by adding the iridium ion supply material a short time after the production of the silver halide is started. For example, the addition of the iridium ion supply material may be started when the silver halide is produced in an amount of 90% by weight of the predetermined amount.

A silver halide containing iridium ions may be used in the present invention, or a silver halide containing iridium ions and a silver halide not containing iridium ions may be mixed.

The content of iridium ions is preferably $1\times10^{-8}$ to $1\times10^{-4}$ mol, more preferably $1\times10^{-7}$ to $1\times10^{-6}$ mol, relative to 1 mol of the total amount of the silver halide contained in the photosensitive layer.

The photosensitive layer preferably contains an appropriate binder for improving its film properties and dispersion properties. Examples of the binder include cellulose esters such as nitrocellulose, cellulose phosphate, cellulose sulfate, cellulose acetate, cellulose propionate, cellulose butyrate, cellulose myristate, cellulose palmitate, cellulose acetate propionate, cellulose acetate butyrate, and the like; cellulose ethers such as methyl cellulose, ethyl cellulose, propyl cellulose, butyl cellulose, and the like; vinyl polymers such as polystyrene, polyvinyl chloride, polyvinyl acetate, polyvinyl butyral, polyvinyl acetal, polyvinyl alcohol, polyvinyl pyrrolidone and the like; copolymers such as styrene-butadiene copolymers, styrene-acrylonitrile copolymers, styrene-butadiene-acrylonitrile copolymers; vinyl chloride-vinyl acetate copolymers, and the like; acrylic polymers such as polymethyl methacrylate, polymethyl acrylate, polybutyl acrylate, polyacrylic acid, polymethacrylic acid, polyacrylamide, polyacrylonitrile and the like; polyesters such as polyethylene terephthalate and the like; polyacrylate polymers such as poly(4,4-isopropylidene-diphenylene-co-1,4,-cyclohexylenedimethylenecarbonate), poly(ethylenedioxy-3,3'-phenylenethiocarbonate), poly(4,4'-isopropylidene-diphenylenecarbonate-co-terephthalate), poly(4,4'-isopropylidenediphenylenecarbonate), poly(4,4'-sec-butylidenephenylenecarbonate), poly(4,4'-isopropylidene-diphenylenecarbonate-block-oxyethylene) and the like; polyamides; polyimides; epoxy polymers; phenolic polymers; polyolefins such as polyethylene, polypropylene, chlorinated polyethylene and the like; natural or synthetic resins such as gelatin and the like.

Polyvinyl acetal such as polyvinyl butyral and polyvinyl formal, or vinyl copolymers such as vinyl chloride-vinyl acetate copolymers are particularly preferred.

The heat developing photosensitive material of the present invention may contain a thiol compound of the formula (IV) or (V) below. The heat developing photosensitive material of the present invention may contain thiol compounds of both formulae (IV) and (V). The addition of a thiol compound of formula (IV) or (V) improves the sensitivity and storability in the unused state, as well as alleviating the temperature control in heat development, i.e., widening the heat development latitude.

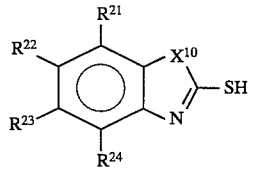

(IV)

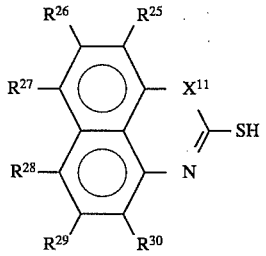

(V)

wherein $R^{21}$ through $R^{30}$ each indicate a hydrogen atom, a substituted or unsubstituted alkyl group, a substituted or unsubstituted alkoxy group, a carboxyl group, a substituted or unsubstituted aryl group, a sulfonic group, a substituted or unsubstituted amino group, a nitro group, a halogen atom, an amido group, an alkenyl group or an alkynyl group, and each of $R^{21}$ and $R^{22}$, $R^{22}$ and $R^{23}$ and $R^{23}$ and $R^{24}$ may form a condensed ring; and $X^{10}$ and $X^{11}$ are each independently —O—, —N($R^{31}$)— or —S—, $R^{31}$ is a hydrogen atom, an alkyl group or an aryl group.

Preferred examples of thiol compounds represented by the formulae (IV) and (V) include the following:

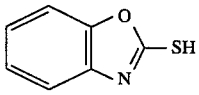

(S-1)

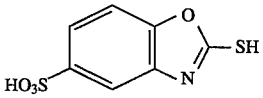

(S-2)

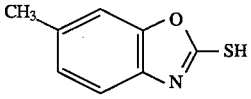

(S-3)

-continued

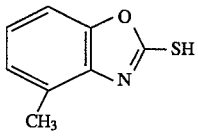

(S-4)

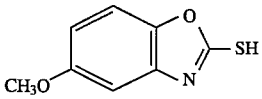

(S-5)

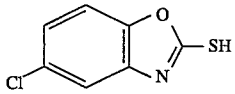

(S-6)

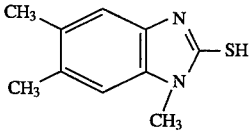

(S-7)

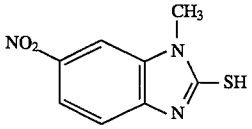

(S-8)

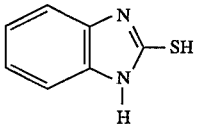

(S-9)

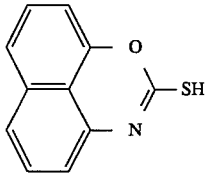

(S-10)

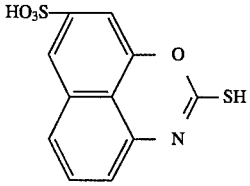

(S-11)

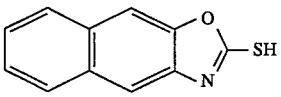

(S-12)

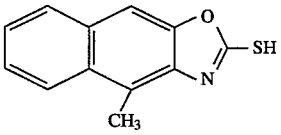

(S-13)

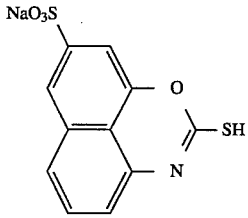

(S-14)

The photosensitive material of the present invention may contain a toning agent as needed. Examples of the toning agent include the phthaladinone or derivatives thereof disclosed in U.S. Pat. No. 3,080,254, the cyclic imides disclosed in U.S. Pat. No. 3,672,904, and the phthaladinone compounds disclosed in Japanese Patent Laid-Open No. 50-32927.

The photosensitive material of the present invention may contain an organic acid for improving the image tone, and stability after image formation as required. It is particularly preferred to employ a single long-chain fatty acid or a combination of at least two long-chain fatty acids.

The preferred compounding ratio of each of the components of the heat developing photosensitive material of the present invention is as follows:

The content of the organic silver salt is preferably 5 to 70% by weight and more preferably 10 to 60% by weight, most preferably 20 to 50% by weight, relative to the photosensitive layer. Even when the photosensitive layer comprises multiple layers, as described below, the content of the organic silver salt is the above value relative to the total amount of the photosensitive layer.

The content of the reducing agent is preferably 0.05 to 3 mol and more preferably 0.2 to 2 mol, relative to 1 mol of organic silver salt.

The photosensitive silver halide is preferably present in an amount of 0.001 to 2 mol and more preferably 0.5 to 1 mol, relative to 1 mol of the organic silver salt. A silver halide forming agent (e.g., tetrabutylammonium bromide, N-bromosuccinimide, or a halogen compound of bromine or iodine) may be used in place of the silver halide. In this case, the content of the silver halide forming agent can be considered as the same as that of the silver halide.

The content of the cyanine dye is preferably within the range of $1\times10^{-5}$ to $1\times10^{-2}$ mol and more preferably $1\times10^{-4}$ to $1\times10^{-3}$ mol, relative to 1 mol of organic silver salt. The content of the cyclic carbonyl compound is preferably $1\times10^{-8}$ to 1.0 mol and more preferably $1\times10^{-6}$ to $1\times10^{-2}$ mol, relative to 1 mol of organic silver salt.

The content of the thiol compound represented by the formula (IV) or (V) and contained according to need is preferably $1.0\times10^{-2}$ to $2.0\times10^{2}$ mol, more preferably $5.0\times10^{-1}$ to $1.0\times10^{2}$ mol and most preferably 1.0 to $8.0\times10^{1}$ mol, relative to 1 mol of cyanine dye.

The content of the binder contained according to need is preferably 0.5 to 10 parts by weight and more preferably 0.5 to 5 parts by weight, relative to 1 part by weight of organic silver salt.

The content of the organic acid contained according to need is preferably 25 mol % to 200 mol % and more preferably 30 mol % to 120 mol %, relative to the amount of the organic silver salt.

The content of the toning agent contained according to need is preferably 0.01 to 5 mol, more preferably 0.05 to 2 mol and most preferably 0.08 to 1 mol, relative to 1 mol of organic silver salt.

The photosensitive material of the present invention can contain an appropriate antifogging agent according to need. Preferred examples of antifogging agents include the mercury compounds disclosed in Japanese Patent Publication No. 47-11113, the 1,2,4-triazole compounds disclosed in Japanese Patent Publication No. 55-42375, the tetrazole compounds disclosed in Japanese Patent Laid-Open No. 57-30828, the benzoic acid compounds disclosed in Japanese Patent Laid-Open No. 57-138630, the compounds having sulfonylthio groups disclosed in Japanese Patent Laid-Open No. 57-147627, and the dibasic acids disclosed in U.S. Pat. No. 4,820,617.

The photosensitive material of the present invention can contain a color protecting agent for preventing a non-image portion from being colored by light after image formation as needed. Preferred examples of such color protecting agents include the compounds disclosed in Japanese Patent Laid-Open No. 61-129642.

The photosensitive material of the present invention can contain a development promotor as required. Preferred examples of development promotors include the alkali metal salt compounds of fatty acids disclosed in Japanese Patent Publication No. 64-8809.

The photosensitive material of the present invention can contain a fluorine-containing surfactant as an antistatic agent as deemed necessary. The fluorine-containing surfactacts disclosed in Japanese Patent Publication No. 64-24245 can be employed in combination with a nonionic surfactant.

The photosensitive material of the present invention can contain an ultraviolet absorber, an antihalation dye (layer), antiirradiation dye, a matting agent, and a fluorescent whitening agent as need be.

The heat developing photosensitive material of the present invention can be obtained by forming a single layer or a plurality of layers containing the above components on an appropriate substrate. In the case of employing a plurality of layers as a laminated photosensitive layer, also known as a multiple photosensitive layer, the layer may comprise a first layer containing the organic silver salt, the silver halide, the cyanine dye and the cyclic carbonyl compound, and a second layer containing the reducing agent. The thiol compound represented by the formula (IV) or (V) and contained as needed is contained in the layer containing a sensitizing dye. Other layers may also be employed containing other additives for the multiple photosensitive layer.

Examples of substrates include synthetic resin films of polyethylene, polypropylene, polyethylene terephthalate, polycarbonate, cellulose acetate and the like; paper such as synthetic paper, paper coated with synthetic resin films of polyethylene, art paper, photographic baryta paper and the like; metal plates (foils) of aluminum and the like; synthetic resin film having metal deposited films, and glass plates.

A protective layer can be provided on the photosensitive layer for improving the transparency of the heat developing photosensitive material, increasing the image density, improving the storability in the unused state, and, under certain circumstances, improving heat resistance as required. A suitable thickness of the protective layer is 1 to 20μ. A thickness smaller than this value has none of the above effects, and a thickness greater than the above imparts no special advantage and causes only an increase in cost. The polymer used in the protective layer is preferably heat resistant, colorless and soluble in a solvent. Examples of such polymers include polyvinyl chloride, polyvinyl acetate, vinyl chloride-vinyl acetate copolymers (preferably containing at least 50 mol % of vinyl chloride), polyvinyl butyral, polystyrene, polymethyl methacrylate, benzyl cellulose, ethyl cellulose, cellulose acetate butyrate, cellulose diacetate, cellulose triacetate, polyvinylidene chloride, chlorinated polypropylene, polyvinyl pyrrolidone, cellulose propionate, polyvinyl formal, polycarbonate, cellulose acetate propionate, gelatin, gelatin derivatives such as phthalic gelatin, acrylamide polymers, polyisobutylene, butadiene-styrene copolymers (any desired monomer ratio), polyvinyl alcohol and the like. The protective layer may contain colloidal silica other than the above binder.

The polymer used in the protective layer preferably has heat resistance of 115° C. or more, and a refractive index of 1.45 or more at 20° C.

In the heat developing photosensitive material of the present invention, when the photosensitive layer, the protective layer and so on having various functions are separately formed, each of the layers can be coated by a coating method. Each of the layers can be formed by, for example, a dip method, an air knife method, a curtain coating method, or an extrusion coating method using a hopper, as disclosed in U.S. Pat. No. 2,681,294. If required, at least two layers may be simultaneously coated.

In the heat developing photosensitive material of the present invention, oxidation-reduction reaction of the organic silver salt and the reducing agent takes place in the exposed image portion by image exposure and heating (heat development), and the metal silver produced by the reaction forms a photographic image.

The heat developing photosensitive material of the present invention permits a pattern to be formed by employing a difference in light absorption of the oxidant (the oxidized reducing agent) produced by the oxidation-reduction reaction. Namely, a pattern can be formed by employing a difference in light absorption between a portion (exposed image portion) where the oxidant is produced and light having a specific wavelength is absorbed, and a portion (unexposed image portion) where the oxidant is not produced and light is less absorbed.

The heat developing photosensitive material of the present invention also permits the formation of a pattern (referred to as "polymerized-unpolymerized pattern" hereinafter) comprising a polymerized portion and a unpolymerized portion using the difference in light absorption. Namely, a polymerizable polymer precursor and a photopolymerization initiator are contained in the photosensitive layer of the present invention so that the polymerized-unpolymerized pattern can be formed by image exposure, heat development and polymerization exposure. This polymerized-unpolymerized pattern is formed due to the phenomenon that polymerization does not proceed in the exposed image portion due to light absorption by silver or the oxidant produced oxidation-reduction reaction in the heat development, and polymerization proceeds in the unexposed image portion.

The polymerizable polymer precursor and the photopolymerization initiator may be contained in the photosensitive layer, or a polymerization layer containing the polymerizable polymer precursor and the photopolymerization initiator may be provided separately from the photosensitive layer.

The photosensitive layer and the polymerization layer may be laminated in this order or the reverse order from the substrate side, or may be provided on both sides of the substrate with the substrate therebetween. The thickness of the photosensitive layer is preferably 0.1 to 50 μm, more preferably 1 to 30 μm, and most preferably 2 to 20 μm. In the multiple photosensitive layer, the respective layers of the photosensitive layer have substantially the same thickness.

A description will now be made of the method of forming an image by using the photosensitive material of the present invention.

Since the photosensitive material of the present invention contains the cyanine dye and cyclic carbonyl compound, it exhibits good photosensitivity and heat development properties, and has high sensitivity to red light and light in the near infrared region. When an image is exposed onto the photosensitive material of the present invention by a semiconductor laser light or LED light, particularly light of 640 nm to 750 nm, in accordance with a desired image, silver nuclei are first produced to form a latent image. The latent image is then appropriately heated (heat development) to develop an image corresponding to the exposed image by oxidation-reduction reaction.

The above image forming method of the present invention can be performed by simple treatment and is suitable for mechanization. Since the method can also use semiconductor laser or LED light, it is a compact and economical method. The photosensitive material of the present invention produces no problem of reciprocity even if the image exposure speed is as low as $1\times10^{-5}$ sec/dot to $1\times10^{-7}$ sec/dot. The reciprocity represents that the image density after development is proportional to the product of image exposure intensity and image exposure time.

The heat developing photosensitive material of the present invention containing the polymerizable polymer precursor and the photopolyermization initiator also permits the formation of the polymerized-unpolymerized pattern by polymerization exposure of the whole surface of the heat developing photosensitive material from the side of the photosensitive layer after the image exposure and heat development.

In the process of polymerization exposure, for example, sunlight, a tungsten lamp, a mercury lamp, a halogen lamp, a xenon lamp, a fluorescent lamp, LED and a laser can be used as a light source.

The wavelength of the light used in polymerization exposure may be the same as or different from the wavelength of the light used in image exposure.

Even if light having the same wavelength as that of image exposure is employed in polymeization exposure, since the photosensitive silver halide generally has sufficiently higher sensitivity than the photopolymerization initiator, a satisfactory latent image can be formed by light having the minimum intensity which produces no photopolymerization in the image exposure process. For example, in the image exposure process, exposure may be performed on the surface of the photosensitive material by using light up to 100 $\mu J/cm^2$, preferably 30 $\mu J/cm^2$ and more preferably 15 $\mu J/cm^2$. In the polymerization exposure, exposure may be performed by light up to about 500 $mJ/cm^2$. Even when the polymerization exposure is not performed, the image exposure process is performed under the same conditions as described above.

The means for heat-developing the photosensitive material of the present invention include various means such as means for bringing the photosensitive material into contact with a simple heating plate or heating drum, means for passing the photosensitive material through a heated space, and means for heating the photosensitive material by high-frequency heating or laser beams. The heating temperature is preferably from 80° to 160° C., more preferably 100° to 160° C. and most preferably 110° to 150° C. The heat development can be performed at a higher or lower temperature within the above range by increasing or decreasing the heating time. The development time is generally 1 to 60 seconds and, preferably, 3 to 20 seconds.

As described above, the present invention has excellent sensitivity to red light or light of a semiconductor laser and LED having an oscillation wavelength within the near infrared region, and has no problem of reciprocity for high-illuminance short-time exposure using a laser or the like, thereby obtaining an image having good quality and substantially no fogging. The heat developing photosensitive material of the present invention is excellent in storability.

The present invention is described in detail below with reference to the illustrative Examples which follow.

EXAMPLE 1

A photosensitive composition having the following composition was prepared under a safety light:

| | |
|---|---|
| Polyvinyl butyral | 5.0 g |
| Silver behenate | 2.5 g |
| Behenic acid | 2.0 g |
| Silver bromide | 0.2 g |
| Phthaladinone | 1.0 g |
| 2,2'-methylenebis (6-t-butyl-4-methylphenol) | 1.0 g |
| Xylene | 30 ml |
| n-butanol | 30 ml |

The above silver bromide was employed in crystal form which used a cubic system having a face index {100} and an average length of one side of 0.07 μm.

5 mg of cyanine dye (I-7) and 1.5 mg of cyclic carbonyl compound (II-23) were dissolved in 6 ml of dimethylformamide (DMF), and the resultant solution was then added to the above photosensitive composition.

The photosensitive composition was coated on a film of polyethylene terephthalate (PET) to form a photosensitive layer having a dry film thickness of 10 μm. A polyvinyl alcohol layer having a dry thickness of 2 μm was coated as a protective layer on the photosensitive layer to obtain a heat developing photosensitive material of the present invention.

The thus-obtained heat developing photosensitive material was measured in sensitivity and fogging density immediately after the photosensitive material was formed and also after the photosensitive material was stored in the unused state for a long period of time. The photosensitive material was stored at 40° C. and 60%RH for 70 hours as an endurance test.

The sensitivity and fogging density were determined by measuring the transmission optical density (O. D.) of the image formed on the heat developing photosensitive material.

Namely, the transmission optical density at an image exposure energy of 0.1 $\mu J/cm^2$ was considered as fogging density. The sensitivity was shown by the image exposure energy required for obtaining the transmission optical density obtained by adding 0.5 to the fogging density. The sensitivity was thus determined by a characteristic curve of transmission optical density to image exposure energy, and the fogging density.

The transmission optical density was measured by using a transmission/diffraction color density meter NLM-STD-Tr (produced by Narumi Shokai).

An image was formed by image exposure on the heat developing photosensitive material using a semiconductor laser having a wavelength of 670 nm, and then heat development was conducted in a heat development machine set at 120° C. for 10 seconds. The spot diameter of the semiconductor laser was 20 μm×40 μm, and the exposure speed was $1.67\times10^{-7}$ sec./dot.

The characteristic curve of the transmission optical density to image exposure energy was formed by forming an image with various levels of image exposure energy and measuring the transmission optical densities of the obtained images. The thus-determined density and fogging density are shown in Table 1.

COMPARATIVE EXAMPLE 1

A heat developing photosensitive material was formed by the same method as that employed in Example 1 except that the cyclic carbonyl compound (II-3) was not employed.

The sensitivity and fogging density of the heat developing photosensitive material were measured by the same method as in Example 1. The results of such measurement are shown in Table 1.

TABLE 1

| | Initial | | After endurance test | |
|---|---|---|---|---|
| | Sensitivity ($\mu J/cm^2$) | Fogging density | Sensitivity ($\mu J/cm^2$) | Fogging density |
| Example 1 | 4.5 | 0.12 | 4.4 | 0.12 |
| Comparative Example 1 | 6.2 | 0.11 | 21.3 | 0.20 |

EXAMPLE 2

A photosensitive composition having the following composition was prepared under a safety light.

| | |
|---|---|
| Polyvinyl formal | 5.0 g |
| Silver benzotriazole | 3.0 g |
| Homophthalic acid | 0.5 g |
| Silver bromide (containing sodium hexachloroiridate (IV) in an amount of $10^{-6}$ mol %) | 0.2 g |
| Phthaladinone | 1.0 g |
| 4,4'-methylenebis(6-t-butyl-4-methylphenol) | 1.0 g |
| Xylene | 35 ml |
| n-butanol | 25 ml |

The above silver bromide crystal exhibited a cubic system having a face index {100} and an average length of one side of 0.06 μm.

7 mg of cyanine dye (I-1) and 0.3 mg of cyclic carbonyl compound (II-25) were dissolved in 2 ml of methanol, and the resultant solution was then added to the above photosensitive composition. A solution obtained by dissolving 70 mg of 2-mercaptobenzothiazole in 1.5 ml of DMF was further added to the photosensitive composition.

The photosensitive composition was coated on a PET film to form a photosensitive layer having a dry film thickness of 10 μm. A polyvinyl alcohol layer having a dry thickness of 2 μm was coated as a protective layer on the photosensitive layer to obtain a heat developing photosensitive material of the present invention.

An image was exposed on the thus-obtained photosensitive material by using a semiconductor laser having a wavelength of 690 nm, and then heat-developed in a heat development machine set at 130° C. for 10 seconds to obtain a good image having a peak at 410 nm. The speed of exposure by the semiconductor laser was $1.50\times10^{-5}$ sec/dot, and the energy of the semiconductor layer on the surface of the photosensitive material was 30 $\mu J/cm^2$.

EXAMPLES 3 TO 6

A photosensitive composition having the following composition was prepared under a safety light:

| | |
|---|---|
| Polyvinyl butyral | 5.0 g |
| Polymethyl methacrylate | 1.0 g |
| Silver behenate | 2.5 g |
| Behenic acid | 2.0 g |
| Azelaic acid | 0.2 g |
| Silver bromide | 0.4 g |
| Phthaladinone | 0.5 g |
| 2,2'-methylenebis (6-t-butyl-4-methylphenol) | 1.0 g |
| Xylene | 40 ml |
| n-butanol | 40 ml |

The above silver bromide crystal showed a cubic system having a face index {100} and an average length of one side of 0.10 μm.

A solution obtained by dissolving each of the cyanine dyes shown in Table 2 in 5 ml of DMF, a solution obtained by dissolving each of the cyclic carbonyl compounds shown in Table 2 in 1 ml of DMF and a solution obtained by dissolving each of the thiol compounds shown in Table 2 in 1 ml of DMF were each added to the prepared photosensitive composition.

In Examples 3 to 6, the amount of the cyanine dye employed was 5 mg, and the amount of the cyclic carbonyl compound used was 0.2 mg. The amount of the thiol compound in each of the examples is shown in Table 2.

A heat developing photosensitive material was formed by the same method as that employed in Example 1 except that each of the thus-obtained photosensitive compositions was employed, and measured for initial sensitivity. The results of such measurement are shown in Table 2.

TABLE 2

| | Cyanine dye | Cyclic carbonyl compound | Thiol compound | Sensitivity (μJ/cm²) |
|---|---|---|---|---|
| Example 3 | I-3 | II-23 | S-3 1.0 mg | 4.3 |
| Example 4 | I-3 | II-23 | S-9 1.5 mg | 4.2 |
| Example 5 | I-3 | II-25 | S-3 1.0 mg | 4.5 |
| Example 6 | I-9 | II-23 | S-3 1.0 mg | 3.9 |

It is evident from the results shown in Table 2 that the combination of the cyanine dye and cyclic carbonyl compound used in the present invention with the thiol compound further improve sensitivity.

EXAMPLE 7

A photosensitive composition was prepared by the same method as that employed in Example 1 except that 1.0 g of 4,4 '-methylenebis (6-t-butyl-2-methylphenol) was used in place of 1.0 g of 2,2 '-methylenebis(6-t-butyl-4-methylphenol). The thus-prepared photosensitive composition was coated on a PET film having a thickness of 6 μm to form a photosensitive layer having a dry thickness of 9 μm, and a polyvinyl alcohol layer having a dry thickness of 2 μm was then provided as a protective layer on the photosensitive layer. A polymerization layer having a thickness of 6 μm was previously formed on the side of the PET film opposite to the side provided with the photosensitive layer. The polymerization layer contained 1.75 parts (parts by weight, applying hereinafter) of Aroncs M6300 (oligoester acrylate produced by Toa Goseikagaku), 2.25 parts of polyester resin (Viron #200, produced by Toyobo), 0.2 part of chlorinated rubber (produced by Sanyokokusaku Pulp), 0.37 part of 2,4-diethyl thioxanthone and 0.37 part of ethyl p-diethylaminobenzoate.

A copper plate was laminated on the polymerization layer to obtain a heat developing photosensitive material of the present invention.

An image was exposed on the thus-obtained photosensitive material using a semiconductor laser having a wavelength of 680 nm, and then heated in a drum-shaped heating machine adjusted to 120° C. for 10 seconds. The energy of the semiconductor laser on the surface of the photosensitive material was 20 μJ/cm². The photosensitive material was then uniformly subjected to polymerization exposure from the side of the photosensitive layer for 2 seconds by using an extra-high pressure mercury lamp (produced by Ushiodenki K. K., USH-500D). In the polymerization exposure, the extra-high pressure mercury lamp was at a distance of 80 cm from the photosensitive material. When the PET film and the copper plate were separated from the photosensitive material, a polymerized portion of the polymerization layer (referred to as "polymerized portion" hereinafter) remained on the copper plate, and an unpolymerized portion of the polymerization layer (referred to as "unpolymerized portion" hereinafter) remained on the PET film. The polymerized portion corresponded to a portion not irradiated with light during image exposure, and the unpolymerized portion corresponded to a portion irradiated with light during image exposure.

What is claimed is:

1. A heat developing photosensitive material comprising a photosensitive layer formed on a substrate, said photosensitive layer comprising an organic silver salt, a reducing agent, a photosensitive silver halide or photosensitive silver halide forming agent, a colorless cyclic carbonyl compound, wherein said colorless cyclic carbonyl compound is a five-membered or six-membered ring represented by the following formula (II):

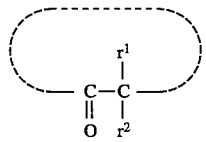

(II)

wherein $r^1$ and $r^2$ are each independently a hydrogen atom or an organic substituent, said organic substituent being selected from the group consisting of an alkyl group, an alkoxy group, a halogen atom, a hydroxyl group, an aryl group, a carboxyl group, an alkoxycarbonyl group, a cyano group, a trifluoromethyl group, an acylamido group, an acyl group, an alkoxycarbonylamino group and a carboalkoxy group and a cyanine dye represented by the following formula (I):

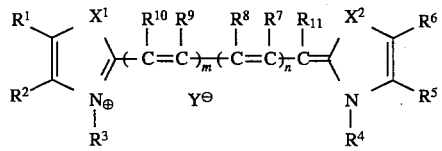

(I)

wherein $R^1$, $R^2$, $R^5$ and $R^6$ are each a hydrogen atom, an alkyl group, an alkoxy group, a halogen atom, a hydroxyl group, an aryl group, a carboxyl group, an alkoxycarbonyl group, a cyano group, a trifluoromethyl group, an amino group, an acylamino group, an acyl group, an acyloxyl group, an alkoxycarbonylamino group or a carboalkoxy group, and $R^1$ and $R^2$ or $R^5$ and $R^6$ may be combined with each other to form a benzene nucleus or a naphtho nucleus; $R^3$ and $R^4$ are each independently an alkyl group, an alkenyl group, an aryl group and an aralkyl group; $R^7$, $R^8$, $R^9$, $R^{10}$ and $R^{11}$ are each a hydrogen atom, a halogen atom, an alkyl group, an alkoxy group, an aryl group, or an amino group, and $R^7$ and $R^8$, $R^9$ and $R^{10}$, $R^7$ and $R^9$, $R^8$ and $R^{10}$ or $R^7$ and $R^{11}$ may be combined with each other to form a ring; $X^1$ and $X^2$ are each an oxygen atom, a sulfur atom or a selenium atom; and m and n are each 0 or an integer from 1 to 3, but m and n are not 0 simultaneously.

2. A heat developing photosensitive material according to claim 1, wherein said formula (II) has, in the ring thereof, an amine represented by the following formula (III):

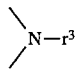

(III)

wherein $r^3$ is a hydrogen atom, an alkyl group, an aralkyl group or an aryl group.

3. A heat developing photosensitive material according to claim 2, wherein said amine represented by said formula (III) is present at one or both sides of

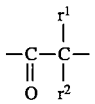

in said formula (II).

4. A heat developing photosensitive material according to claim 1, wherein said cyclic carbonyl compound is selected from the group consisting of rhodamine, hydantoin, or a derivative thereof.

5. A heat developing photosensitive material according to claim 1, wherein said photosensitive layer further contains a thiol compound represented by the following formula (IV) or (V):

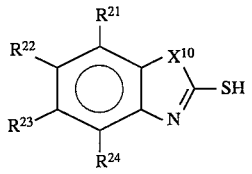

(IV)

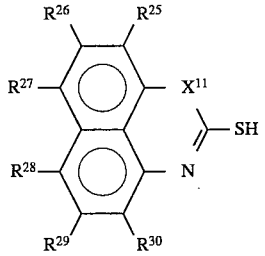

(V)

wherein $R^{21}$ through $R^{30}$ are each a hydrogen atom, an alkyl group, an alkoxy group, a carboxyl group, an aryl group, a sulfonic group, an amino group, a nitro group, a halogen atom, an amido group, an alkenyl group or an alkynyl group;

$X^{10}$ and $X^{11}$ are each independently —O—, —N($R^{31}$)— or —S—, and $R^{31}$ is a hydrogen atom, an alkyl group or an aryl group.

6. A method of forming an image comprising: (a) exposing an image on the heat developing photosensitive material of claim 1, and (b) heating of said exposed heat developing photosensitive material.

* * * * *